United States Patent [19]

Fildan

[11] 4,000,544

[45] Jan. 4, 1977

[54] CLASP

[76] Inventor: Gerhard Fildan, 31 Kriehubergasse, A-1050 Vienna, Austria

[22] Filed: Sept. 16, 1975

[21] Appl. No.: 614,029

[30] Foreign Application Priority Data

| | | |
|---|---|---|
| Sept. 19, 1974 | Austria | 7533/74 |
| Jan. 13, 1975 | Austria | 197/75 |
| Feb. 6, 1975 | Austria | 918/75 |
| May 26, 1975 | Austria | 3988/75 |
| Aug. 14, 1975 | Austria | 6349/75 |

[52] U.S. Cl. ..... 24/201 CF; 24/75

[51] Int. Cl.[2] ..... A44B 11/25; A44B 17/00

[58] Field of Search .... 24/201 BN, 201 CF, 201 R, 24/201 S, 230 SL, 230 R, 75

[56] References Cited

UNITED STATES PATENTS

| | | | |
|---|---|---|---|
| 760,171 | 5/1904 | Atwell | 24/75 |
| 796,414 | 8/1905 | Chayes | 24/75 |
| 2,030,563 | 2/1936 | Barnes | 24/201 BN |
| 2,287,308 | 6/1942 | Hill | 24/75 |
| 2,668,954 | 2/1954 | Frohlich | 24/201 CF X |
| 3,081,506 | 3/1963 | Higuchi | 24/75 |
| 3,372,440 | 3/1968 | Burson | 24/201 R X |
| 3,900,927 | 8/1975 | D'Angelo et al. | 24/201 BN |

FOREIGN PATENTS OR APPLICATIONS

| | | | |
|---|---|---|---|
| 819,799 | 9/1959 | United Kingdom | 24/201 CF |

*Primary Examiner*—Donald A. Griffin
*Attorney, Agent, or Firm*—Imirie, Smiley & Linn

[57] ABSTRACT

A clasp assembly for various items of clothing, particularly brassieres, including at least two clasp members being attachable to the ends of the clothing items to be connected by the joint of said clasp members which can be connected together in articulated manner and also detached from one another, the joint being formed from a longitudinally slotted cylinder on one of the clasp members and disposed at right angles to the connecting line and from a roll or coupling bar on the other clasp member, which roll is insertable into the cylinder. The cylinder slot is arranged in a plane at an angle of 60° to 90° to the clasp plane, so that the two joint portions are inserted into one another in an angular position to each other and are brought into the fixed extended position by swivelling, whereby in the lateral area of said slot there is provided a recess into which the supporting web of the roll is received at its remote side from the joint when swivelling the clasp portions from the angular position into the extended position.

10 Claims, 18 Drawing Figures

51
52
53
9
8
7
12
1a
1b
5
54

CLASP

SUMMARY OF INVENTION

A clasp for items of clothing comprising at least two clasp members, the first member comprising a longitudinally slotted cylinder and the second member comprising a roll being insertable into the cylinder when the two clasp member planes are in perpendicular or angular position to each other, and assuming a fixed position when the roll is swivelled into the same plane as the cylinder member plane.

The invention relates to a clasp with at least two clasp portions which can be interconnected in articulated manner and which can be detached from one another, which at the end thereof remote from the joint can be connected to the ends of two detachably connectable members, whereby the joint is formed from a longitudinally slotted cylinder at right angles to the connecting line and a roll which can be inserted in the latter.

The clasp serves more particularly for the detachable connection of two pieces of fabric, in the case of underclothing, garments, swimming costumes or the like, but more particularly as the front clasp for a brassiere. However, it can also be used for joining the links of a chain.

Known clasps of this type have the slot for guiding the web of the slide-in portion in the clasp plane, i.e. diametrically opposite in the case of a substantially cylindrical socket portion of occasionally allowing an eyelet attachment, which has the disadvantage of an undesired opening of the clasp.

In another known clasp comprising two clasp portions one clasp portion has a joint socket with a central cavity for receiving the joint ball provided on the other clasp portion, which via a radial bore in the joint socket can be inserted in the cavity thereof and is constructed at the end of a narrow connecting arm, which in the closed position is received by a slot provided in the joint socket. At the end facing the radial bore and the cavity this slot has a width which is less than the joint ball diameter and extends substantially in the connecting plane between the fabric portions to be joined together. Due to the relatively complicated guidance of the two clasp portions during insertion and taking apart this clasp requires skill on the part of the person using it.

To counteract the indicated shortcomings of the known clasps in a clasp of the type indicated hereinbefore the invention proposes that the slot is arranged in a plane at an angle of preferably 60° to 90° to the clasp, so that the two joint portions are inserted in one another when in a reciprocal angular position and by swivelling are brought into an extended position corresponding to the clasp position, whereby in the slot area is provided a laterally following space for the passage of the web on pivoting the clasp portions from the angular position into the extended position.

Further details of the invention are explained relative to a number of embodiments of the said clasp with reference to the attached drawings.

DETAILED DESCRIPTION OF THE PREFERRED EMBODIMENTS

Figure 1:
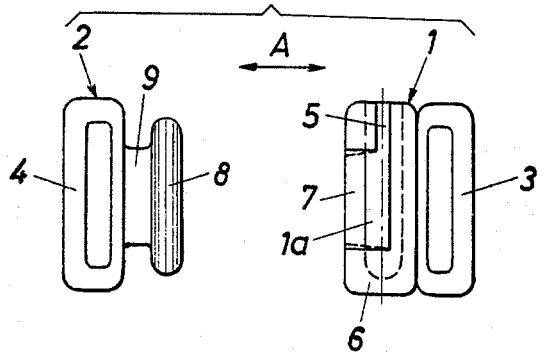
FIG. 1 is a plan view of a first embodiment of a clasp according to the present invention in an open position.

The clasp according to FIGS. 1 to 4 comprises a socket portion 1 and a slide-in member 2 whereof each has an eyelet attachment 3 or 4. The socket member 1 substantially has the shape of a hollow cylinder open at one side, positioned at right angles to the pulling direction of the clasp indicated by the double arrow A. The hollow cylinder has a longitudinal slot 5, which only communicates to the outside at the open end of the cylinder, being provided in a cylinder wall perpendicular to the clasp plane on the side facing the body, in the case of a front clasp for a brassiere.

Slot 5 terminates at an interval from the base 6 of socket member 1 and has a widened portion 7, recessed from the edge of slot 5 remote from eyelet 3 and which is substantially symmetrical to the said hollow cylinder. It is hereby possible for the widened portion 7 to conically taper, as shown in FIG. 1, whereby the web 9 must have a corresponding shape, so that in the end position of the two clasp portions there is a slight clamping action.

Figure 2:
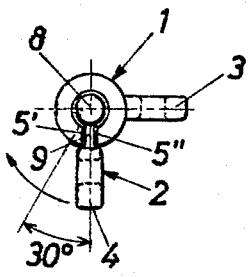
FIG. 2 is a top view of the assembled clasp of FIG. 1 in an intermediate position.
Figure 3:
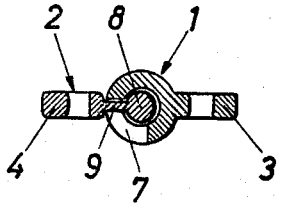
FIG. 3 is a sectional view taken along line III—III of FIG. 4.
Figure 4:
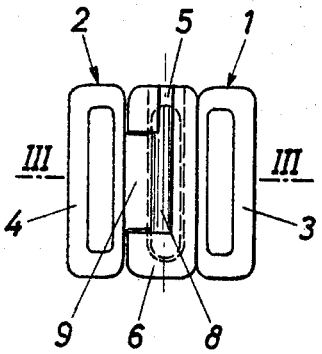
FIG. 4 is a plan view of the clasp of FIG. 1 in a closed position.

Furthermore, the wall 5′ FIG. 2 of the slot facing widened portion 7 need not be parallel to the other wall 5″, as shown, but can be inclined relative thereto in order to facilitate the insertion and removal of the web. As indicated in dotted lines the inclined position can preferably be at an angle of up to 30°, whereby wall 5′ is positioned radially.

The slide-in member comprises a roll or coupling bar 8 which fills up the inner space of socket member 1 and a following web 9 connecting roll 8 with eyelet 4. The length of web 9 is substantially the same as the length of widened portion 7, but smaller than the length of roll 8. Web 9 is positioned symmetrically to roll 8, so that both ends thereof overlap the web by the same length.

Figure 5:
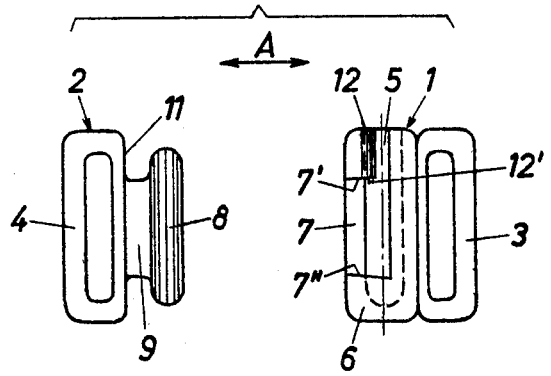
FIG. 5 is a plan view of a second embodiment of the clasp according to the present invention in an open position.
Figure 6:
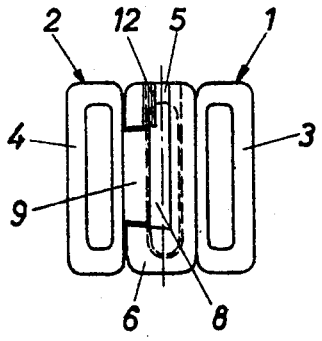
FIG. 6 is a plan view of the assembled clasp of FIG. 5 in a closed position.
Figure 7:
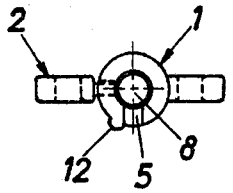
FIG. 7 is a top view of the clasp of FIGS. 5 and 6 in a closed position.

The clasp according to FIGS. 5 to 7, similar to that of FIGS. 1 to 4, comprises a socket member 1 and a slide-in member 2, whereby the same components are allocated the same reference numerals. To prevent an undesired pivoting back of the clasp members from the extended position into the angular position, when the two members can become detached, this danger for example occurring more particularly in the case of athletic movements of the shoulder, a snap fastener is provided which acts in the case of reciprocal pivoting of the two clasp members. As represented in the present embodiment the snap fastener can have a projection 12 in the area of the outer slot edge over which eyelet 4 is guided with its inner terminal edge portion 11 linked to web 9, during the reciprocal pivoting of the clasp members. When passing over the edge portion 11 projection 12 exerts a resistance on the latter, but this resistance can be easily overcome and forms a type of snap fastener, which must also be overcome on opening the clasp.

This projection can be in the form of a bar, lug or the like and as a varient of the selected embodiment can be provided on either side of widened portion 7 or as shown by dotted lines at 12′ in FIG. 5 1 can be constructed as a lug on one or both sides of wall 7′ or wall 7″ bounding widened portion 7, in the latter case cooperating with the outer narrow side of web 9.

It is important for the construction of the snap fastener that socket member 1 have a projection projecting into the path of the slide-in member on pivoting the same and which, although it can be easily overcome, prevents an undesired pivoting back of slide-in member 2 relative to socket member 1.

Figure 8:
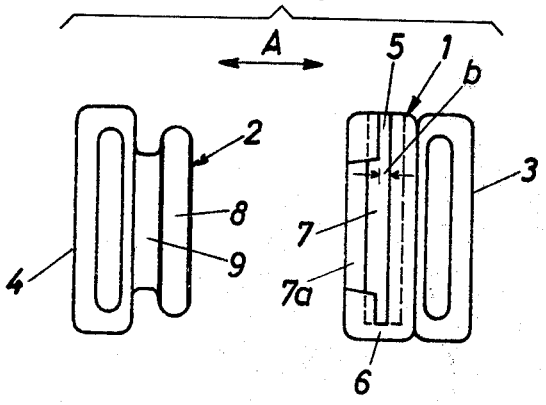
FIG. 8 is a plan view of a third embodiment of the clasp according to the present invention in an open position.
Figure 9:
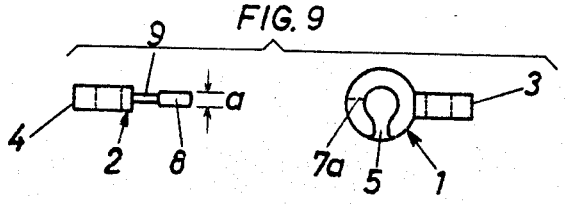
FIG. 9 is a top view of the clasp portions of FIG. 8.

In the clasps according to FIGS. 8 and 9 the thickness —*a*— of roll 8, measured perpendicular to the clasp plane, is substantially the same width —*b*— of slot 5 or is slightly thinner, so that as would be explained hereinafter, roll 8 can be radially inserted through slot 5. The shape of the roll corresponds to that of a cylinder with a diameter which is approximately the same or slightly smaller than the internal diameter of socket member 1, whereby the cylinder is flattened at two diametrically opposite points parallel to the pulling direction. Clasps constructed in this way can be inserted and detached relative to one another in both the radial and axial directions.

Unlike in the two previously described embodiments of the clasp with a socket member 1 open on one side, socket member 1 can also be open on both sides, so that slide-in member 2 can either be inserted axially in both directions or radially.

In all the described clasps of the construction according to the invention the base surface 7*a* of widened portion 7 forming the stop face for web 9 is positioned parallel to the central plane located in the pulling direction and is staggered by half the web thickness relative to the unslotted side of the socket, so that in the closed position of the clasp members a precise extended position thereof can be obtained, in which the two eyelet attachments are located in a common plane.

In the embodiment according to FIGS. 10 to 13, the snap fastener comprises a pin 12 projecting approximately centrally from the wall defining the base side of widened portion 7 and having a terminal edge extension 12′ and with a corresponding opening 12*a* in web 9 acting in snap fastener-type manner with the pin 12 or its extension 12′.

Figure 12:
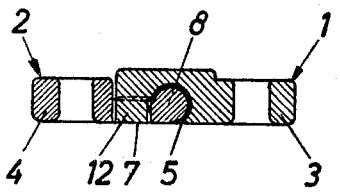
FIG. 12 is a sectional view taken along line XII—XII of FIG. 10.
Figure 13:
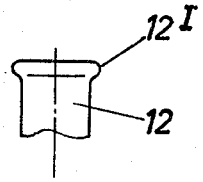
FIG. 13 is a partial detailed view of an embodiment of the pin of the snap-fastener of the clasp of FIG. 10.

As can be gathered from FIG. 12 on the body side the two clasp members 1,2 are flat, so that in the closed positions they form a planar closure, with no projection to produce pressure points. To this end the individual components of the clasp members, i.e. the hollow cylinder and the eyelet attachment 3 of socket member 1, as well as the web 9, eyelet attachment 4 and roll 8 of slide-in member 2 are constructed in such a way that their cross section located in the pulling direction can always be enclosed by a rectangle, whereof at least the side facing the wearer's body coincides with the sealing face of the particular component. Both web 9 and the hollow cylinder of the socket member are always connected eccentrically to the appropriate eyelet attachment 4 or 3.

In all cases the clasp is operated in such a way that the slide-in member 2, perpendicular to the pulling plane, is axially or radially inserted into the socket member and in the inserted position in the extended position of the clasp is turned, while overcoming the resistance of the snap fastener, so that web 9 enters widened portion 7 and with the latter forms a bayonet catch. During this movement the ends of roll 8 are guided in the two socket ends, so that an easy and reliable manipulation of the clasp is possible. To release the clasp the two clasp members are moved in the opposite direction.

Figure 14:
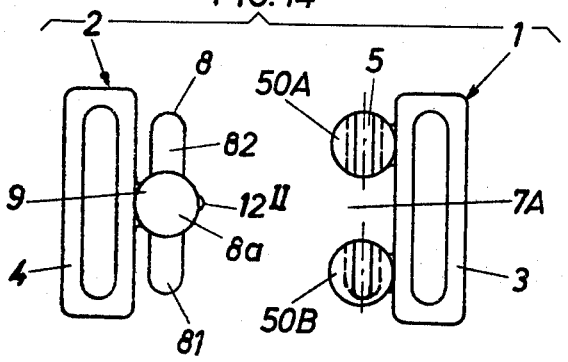
FIG. 14 is a plan view of a fifth embodiment of the clasp according to the present invention in an open position.
Figure 15:
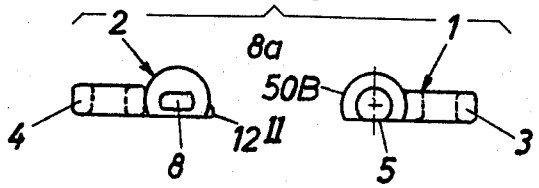
FIG. 15 is a top view of the clasp portions of FIG. 14.
Figure 10:
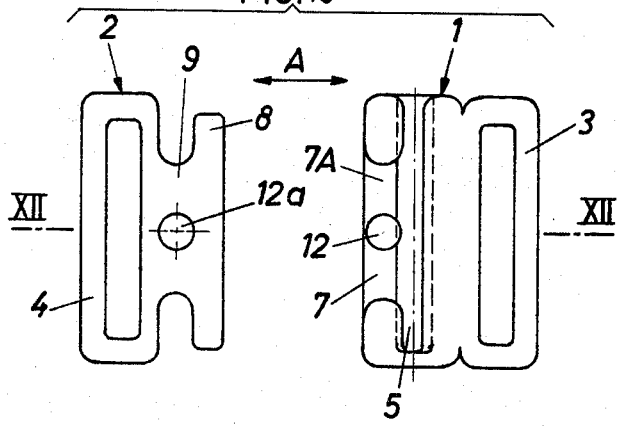
FIG. 10 is a plan view of a fourth embodiment of the clasp according to the present invention in an open condition.
Figure 11:
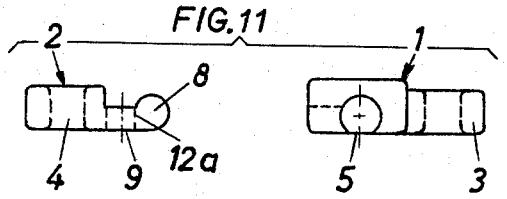
FIG. 11 is a top view of the clasp portions of FIG. 10.

In the embodiment of the clasp according to FIGS. 14 and 15, the hollow cylinder of socket member 1 is interrupted in the area of its widened portion 7, so that two cylinder portions are formed, which in the present case are constructed as flat sphere portions 50A, 50B between which an intermediate space 7A is formed, fulfilling the function of widened portion 7. Accordingly, roll 8 is centrally provided with a flat sphere portion 8*a* which also forms part of web 9. Sphere portion 8*a* is shaped like sphere portions 50A, 50B and ends on both sides in the flat roll portions 81, 82, whose thickness can correspond to the width of the slots of sphere portions 50A, 50B, so that slide-in member 2 can be radially inserted in socket member 1. The snap fastener is formed by a lug 12″ projecting centrally in the pulling direction from sphere portion 8*a*, together with the wall of eyelet attachment 3 which is opposite to the said lug in the closed position.

Figures 16, 17, 18:
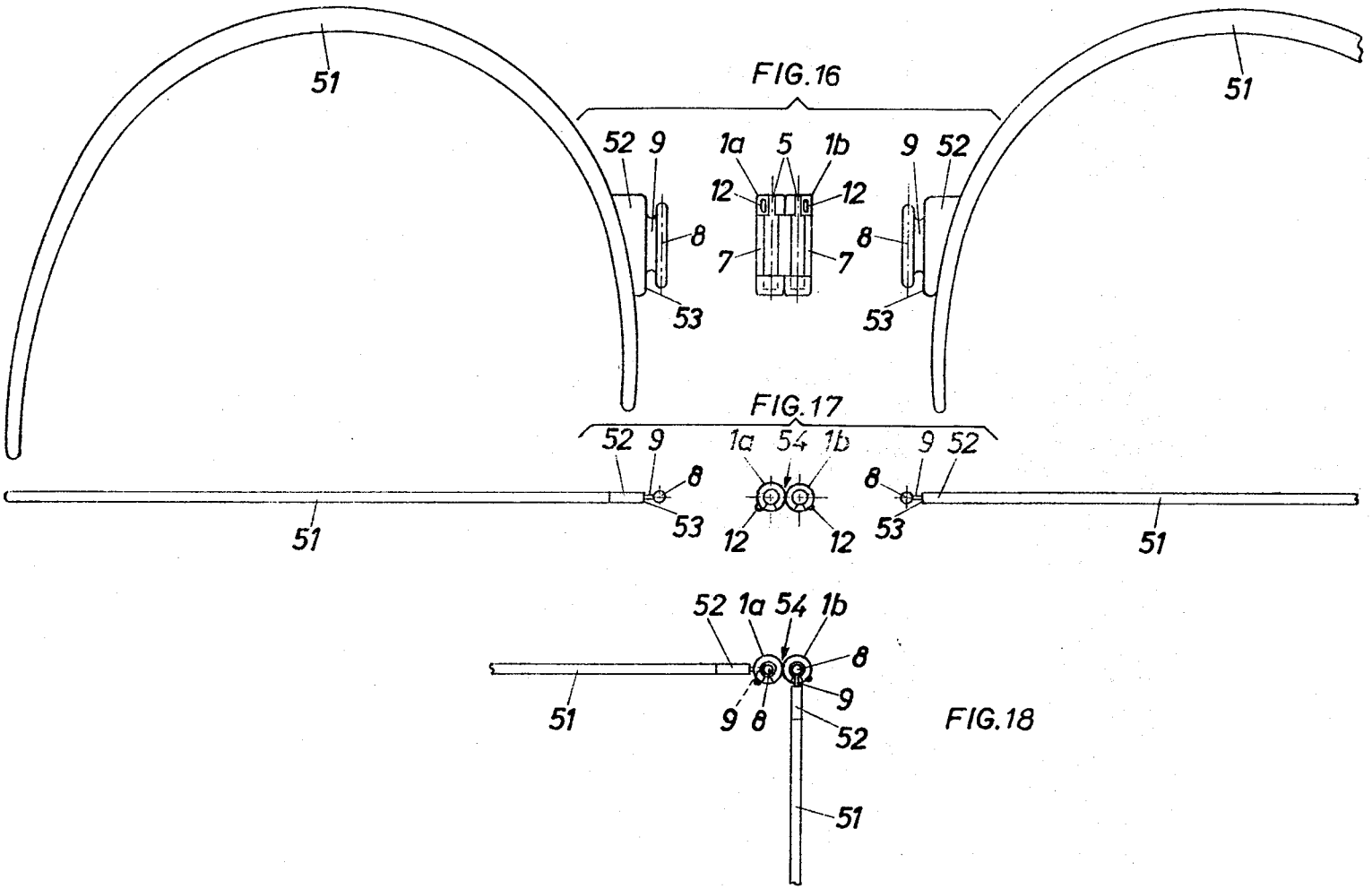
FIG. 16 is a plan view of a sixth embodiment of the clasp according to the present invention in a disassembled position.
FIG. 17 is a top view of the clasp portions of FIG. 16.
FIG. 18 is a top view similar to FIG. 17 but in an assembled position, with one clasp portion in a final position for use and the other portion in an intermediate position.

The clasp of the embodiment according to FIGS. 16 to 18 serves as the front clasp for a brassiere, whose cup edges are stiffened with plastic rods curved in accordance with the circumferential shape thereof. To this end the rods 51 are provided in the clasp area with an attachment 52, whose wall thickness corresponds to the rod thickness. The attachments 52 of both rods have facing parallel edges 53, running at right angles to the pulling direction of the clasp, whereof each carries a roll 8 on a web 9.

A connecting piece 54 is provided for connecting the rolls 8 of both brassiere cups and this comprises two cylinders 1*a*, 1*b* similar to the socket member, whereof each has a longitudinal slot 5 and a widened portion 7, whereby the two widened portions in each case lead towards the outer edge of connecting piece 54 and are homologous to one another.

Each of the two cylinders 1*a*, 1*b* is provided with an extension 12, known from the previous embodiments, which forms a snap fastener with the clasp member to be inserted into cylinder 1*a*, 1*b*, whereby the extensions are not identical in such a way that the snap fasteners act with unequal power and, as to be described hereinafter, on opening the clasp the connecting piece 54 remains suspended on roll 8 of the clasp member with the more powerfully acting snap fastener.

The described clasp is manipulated in the manner described hereinbefore. For the case that the for example left hand cylinder 1*a* in the drawing is provided with an extension 12 giving a more powerfully acting snap fastener than the extension of cylinder 1*b*, on opening the clasp the right hand clasp member in the drawing is always manipulated. For inserting or removing roll 8 into or out of cylinder 1*b* the clasp member is pivoted into the position shown in FIG. 18 perpendicular to the clasp pulling direction. This position can also be assumed when the brassiere is being worn, because all the clasp members are made in one piece from plastic and rods 51 can be easily bent and need not assume a position precisely perpendicular to the pulling direction, such as is shown for ease of reference in FIG. 16.

The attachments 52 can be constructed as a frame, whose members pass into the rods 51 and aid the sewing thereof.

It is obviously possible within the scope of the invention to perform various constructional modifications. It is thus for example possible to provide the connecting piece with roll portions, while the ends to be connected receive socket or cylinder portions. The connection of the clasp members with brassiere rods is described only as one possible application. It is in fact possible to equip in analogous manner any connection of two ends with randomly fitted end portions e.g. eyelets, clips, clasps or the like, whereon are shaped the roll portion or the socket portion, so that the clasp can be used for all types of underclothing, garments, swimming costumes and the like. Furthermore, both roll 8 and cylinder 1*a*, 1*b* can be given any appropriate shape, whereby it is also possible to provide more than two clasp members for the connecting piece.

I claim:

1. Clasp for items of clothing, particularly brassieres, comprising at least two clasp members which can be joined together in articulated manner and also detached from one another, whereby the said clasp members can be connected to the ends of the items to be connected at the end thereof remote from the joint, whereby the latter is formed from a longitudinally slotted member having a cylindrical bore disposed on one of said clasp members at right angles to the connecting line between said clasp members and by a roll insertable in the said cylindrical bore, said roll connected to the other of said clasp members by a web, wherein the slot is arranged in a plane at an angle of 60° to 90° to the clasp plane, so that the two joint portions are inserted into one another in an angular position and are brought into an extended position corresponding to the clasp position by swivelling, whereby in the area of said slot is provided a space laterally communicating with said slot for receiving the web on swivelling the clasp portions from the angular position into the extended position, said one clasp portion including a protrusion acting in a snap fastener like manner and disposed in the path of the other clasp portion on reciprocal rotation of the two portions with respect to each other.

2. Clasp according to claim 1, wherein the space for receiving the web is constructed as a widened portion of the slot recessed into the bore wall.

3. Clasp according to claim 1, wherein the bore is provided in a portion of one clasp member constructed as a socket, whereby the base surface of said web receiving space forms a stop face for the web and is positioned parallel to the central plane located in the pulling direction being staggered relative to the latter towards the unslotted side of the socket by half the thickness of the web.

4. Clasp according to claim 1, wherein the slotted surface of the cylinder containing member is made flat and seals off flush in substantially the same plane both the roll inserted in the cylinder bore and any connecting pieces on the cylinder and roll.

5. Clasp according to claim 4, wherein for securing the clasp members in the closed position the wall of the socket member facing the web of the roll has a projecting pin which cooperates with a corresponding opening in the web in a snap fastener-like manner.

6. Clasp according to claim 1, wherein the two items to be connected are provided in identical manner with a roll portion and in that a connecting piece is provided, which comprises two interconnected outwardly directed socket portions each having a slot for receiving a respective one of the rolls to form a hinge connection with the roll portions.

7. Clasp according to claim 6, wherein the socket portions of the connecting piece have non-identical extensions for forming snap fasteners with an unequal strength with respect to their respective roll portions.

8. Clasp according to claim 1, wherein the thickness of the roll perpendicular to the clasp plane is at the maximum equal to the width of the slot of the socket member.

9. Clasp according to claim 1, wherein the socket member and the roll member comprise complementary sphere portions at right angles to the pulling directions.

10. Clasp according to claim 9, wherein the roll member has a centrally symmetrical sphere portion having on both sides bar portions projecting at right angles to the pulling direction and parallel to the latter, and wherein the socket member has two sphere portions flanking the sphere portion on either side in the closed position with a slot positioned perpendicularly to the pulling direction for the insertion of the bars from the narrow side and perpendicular to the pulling direction.

* * * * *